United States Patent [19]

Jeffries

[11] Patent Number: 4,977,400

[45] Date of Patent: Dec. 11, 1990

[54] AUTO RAMP SAFETY SIGNAL

[76] Inventor: Harry Jeffries, 1858 103rd Ave., Coon Rapids, Minn. 55433

[21] Appl. No.: 385,618

[22] Filed: Jul. 27, 1989

[51] Int. Cl.[5] ..... G08B 5/36

[52] U.S. Cl. ..... 340/932.2; 340/436; 254/88

[58] Field of Search ..... 340/436, 425.5, 932.2, 340/666, 933; 116/67 R, 28 R; 254/88

[56] References Cited

U.S. PATENT DOCUMENTS

| | | | |
|---|---|---|---|
| 2,321,602 | 6/1943 | Jensen | 254/88 |
| 2,450,648 | 10/1948 | Felzer | 254/88 |
| 2,502,924 | 4/1950 | Care et al. | 254/88 |
| 3,178,156 | 4/1965 | Rigers | 254/88 |
| 3,824,536 | 7/1974 | Cherico | 340/932.2 X |
| 3,847,376 | 11/1974 | Binding | 340/932.2 X |
| 4,050,403 | 9/1977 | Miller | 254/88 |

*Primary Examiner*—Joseph A. Orsino
*Assistant Examiner*—Brian R. Tumm
*Attorney, Agent, or Firm*—Henderson & Sturm

[57] ABSTRACT

An add on signalling apparatus (10) for wheel ramps (50) to warn the operator of a vehicle (100) when one of the wheels (101) of the vehicle (100) has reached a selected location on the horizontal support surface (52) of the wheel ramp (50) by the movement of a pressure plate member (23) against a push button (17) to energize a power source (16) to provide electrical current to an elevated source of illumination (31).

6 Claims, 1 Drawing Sheet

AUTO RAMP SAFETY SIGNAL

TECHNICAL FIELD

The present invention relates generally to signaling devices incorporated into an automobile ramp device to notify the operator of an automobile when one of the wheels of the vehicle has reached predetermined location on a ramp.

BACKGROUND OF THE INVENTION

As can be seen by reference to the following U.S. Pat. No's: 2,502,924; 2,321,602; 4,050,403; and 2,450,648 the prior art is replete with myriad and diverse automobile ramp constructions, some of which are provided with signaling devices and others which are not.

While all of the aforementioned prior art devices are more than adequate for the basic purpose and function for which they have been specifically designed, these patented structures do by no means define the ultimate design in ramp signaling apparatus.

As a consequence of the foregoing situation there has existed a longstanding need among users of automobile ramp devices for a simple effective and fail-safe signaling structure that is wheel versus axle actuated; and, one which can easily be adaptable to most existing metal ramp structures to provide a positive signal which clearly indicates when the wheel of the vehicle has reached a particular location on the ramp surface; and, the provision of such a device is the stated objective of the present invention.

SUMMARY OF THE INVENTION

Briefly stated, the present invention involves an add on signaling apparatus that can be adapted to most metal wheel ramp devices wherein the signal actuator can be positioned at a selected position on the top surface of the ramp to visually signal the operator of the vehicle that the vehicle wheel has reached a predetermined location on the ramp.

The add on signaling apparatus is adapted to be either fixedly or movably mounted on the ramp surface; and, the apparatus comprises in general: a mounting unit; a signal actuator unit; and a signal unit.

In one version of the preferred embodiment the mounting unit comprises in general: a threaded nut and bolt arrangement which cooperates with a portion of the signal actuator unit and the ramp to fixedly secure the apparatus to the ramp.

In the other versions of the preferred embodiment magnetic or clamp means are used to operatively and selectively engage the apparatus at a desired location relative to the ramp.

In addition, the signal actuator unit comprises a pivoted actuator plate operatively engaged with a push button operated power source wherein the depression of the actuator plate depresses the button to energize the power source.

The signal unit comprises a signal member mounted on an elevated support member wherein the signal member is electrically coupled to the power source such that the depression of the actuator button will energize the signal member in a well recognized fashion.

BRIEF DESCRIPTION OF THE DRAWINGS

These and other objects, advantages and novel features of the invention will become apparent from the detailed description of the best mode for carrying out the preferred embodiments of the invention which follows; particularly when considered in conjunction with the accompanying drawings, wherein.

BEST MODE FOR CARRYING OUT THE INVENTION

Figure 1:
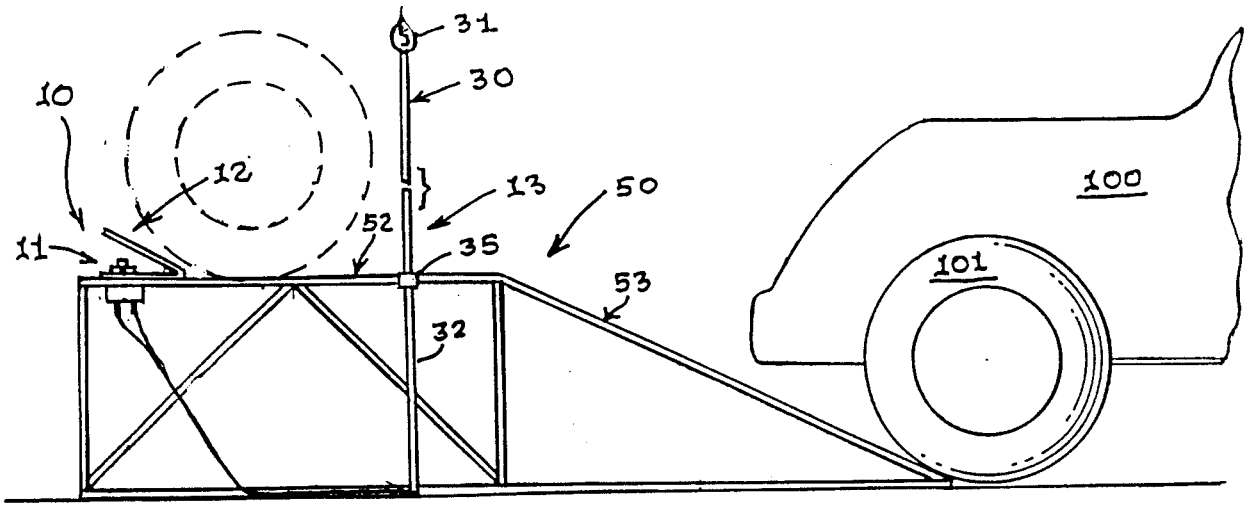
FIG. 1 is a side elevation view of the apparatus in its intended environment.

As can be seen by reference to the drawings and in particular to FIG. 1, the add on signaling apparatus that forms the basis of the present invention is designated generally by the reference numeral (10). The apparatus (10) comprises in general a mounting unit (11); a signal actuating unit (12); and, a signal unit (13). These units will now be described in seriatim fashion.

Figure 2:
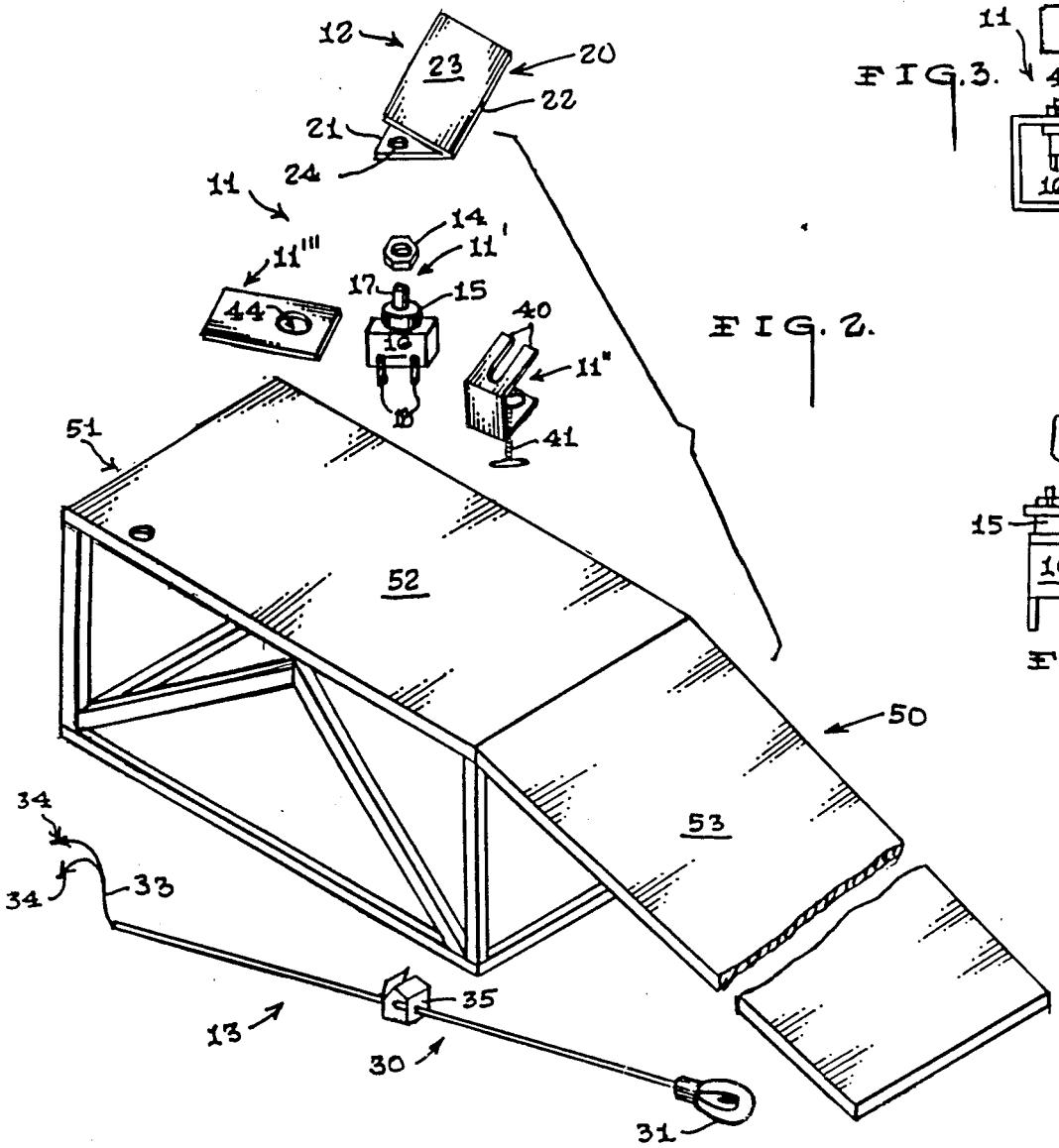
FIG. 2 is an exploded perspective view of the apparatus and various mounting means used to engage the apparatus to the vehicle ramp.

Prior to embarking upon a detailed description of the apparatus (10) it would first be advisable to briefly describe the specific environment in which the apparatus (10) is intended for use. As shown in FIGS. 1 and 2, the apparatus (10) is designed to be operatively engaged with a wheel ramp (50) fabricated from metal (51) and having a generally flat top support surface (52) and an upwardly inclined ramp surface (53) that will permit at least one wheel (101) of a vehicle (100) to be driven up the wheel ramp (50) to a desired location on the generally flat top support surface (52).

In the first version of the preferred embodiment depicted in FIGS. 1 and 2, it can be seen that the mounting unit (11) comprises a generally fixed primary mounting unit (11') including a nut (14) and bolt (15) arrangement operatively engaged with a power source member (16) including a battery, or the like wherein the power source member (16) is further provided with a push button switch (17) which will energize the power source member (16) in a well recognized fashion; and, a pair of electrical leads (18) which project from the bottom of the power source member (16).

As can also be seen by reference to FIGS. 1 and 2, the signal actuator unit (12) comprises an elongated hinged actuator plate member (20) having an apertured base plate (21) hingedly connected as at (22) to an upper pressure plate member (23); wherein, the off-set aperture (24) in the base plate (21) is dimensioned to receive the threaded bolt (15) which surrounds the push button (17); such that the threaded nut (14) can engage the threaded bolt (15) to captively engage the aperture base plate member (21) intermediate the nut (14) and the power source member (16).

Still referring to FIGS. 1 and 2, it can be seen that the signal unit (13) comprises a signal member (30) including a source of illumination (31) mounted on an elongated support rod (32) and further provided with an electrical lead (33) having electrical connector means (34) such as alligator clips or the like for forming an electrical connection between the source of illumination (31) and the power source (16).

In addition, the elongated support rod (32) is further provided with a clamp member (35) for frictionally engaging the upper and lower portions of the top support surface (52) of the wheel ramp (50) to support the support rod (32) in a vertical position relative to the wheel ramp (50) so that the illumination source (31) will be visible to the operator of the vehicle (100).

In the generally fixed version of the apparatus (10) described thus far, it is necessary to structurally modify the top support surface (52) of the wheel ramp (50) by drilling an enlarged aperture (55) that will accommodate the threaded bolt (15) on the power source member (16) whereby the apparatus (10) may be fixedly secured to the wheel ramp (50) in a well recognized manner.

Figure 3:
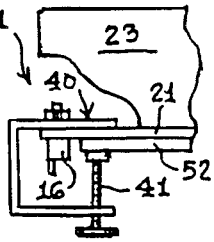
FIG. 3 is an enlarged detail view of one version of the movable mounting means; and, FIG. 4 is an enlarged detail view of another version of the movable mounting means.

In the first movable version of the preferred embodiment depicted in FIGS. 2 and 3, it can be seen that the primary mounting unit (11') further comprises an auxiliary C-shaped adjustable clamp member (11'') that is dimensioned to captively surround the primary mounting unit (11'); wherein, the adjustable clamp member (11'') is provided with spaced arms (40) that will accommodate the threaded bolt member (15); and an adjustment member (41) whereby the adjustable clamp member (11'') engages the top of the actuator base plate member (21) and the bottom of the horizontal ramp support surface (52) to suspend the power source member (16) in an off-set relationship and at a selected location relative to the side of the wheel ramp (50).

Figure 4:
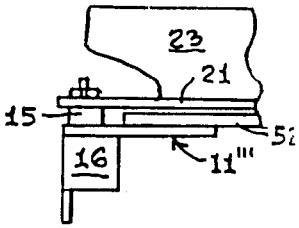

In the second movable version of the preferred embodiment depicted in FIGS. 2 and 4, it can be seen that the primary mounting unit (11') further comprises an auxiliary apertured elongated magnetic plate member (11'''); wherein, the magnetic plate member (11''') is provided with an enlarged off-set aperture (44) which is dimensioned to accommodate the passage of the threaded bolt member (15) yet prevent the passage of the threaded nut (14); such that the power source member (16) may be magnetically suspended from the bottom of the top support surface (52) of the wheel ramp at a desired location.

Once the apparatus (10) has been installed on the wheel ramp (50), the pressure plate member (23) extends substantially across the width of the ramp support surface (52) such that when the wheel (101) of the vehicle (100) encounters the pressure plate member (23) it will move the pressure plate member (23) against the push button (17) to energize the power source member (16) and provide electrical current to the elevated source of illumination (31) so that the vehicle operator knows that the wheel (101) has reached a certain location on the wheel ramp (50).

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. An add on signaling apparatus for wheel ramps having a horizontal top support surface and an upwardly inclined ramp surface wherein the horizontal top support surface is dimensioned to accommodate the wheel of a vehicle; and wherein the apparatus comprises:

a primary mounting unit for operatively engaging the apparatus with said ramp support surface including a power source member provided with: a push button to energize the power source member; a pair of electrical leads; and, a threaded nut and bolt arrangement;

a signal actuating unit comprising an elongated pressure plate member operatively associated with said ramp support surface and extending substantially across the width of said ramp support surface wherein said pressure plate member is operatively associated with said push button to energize the power source member upon contact of a vehicle wheel with the pressure plate member; and, a signal unit including an elevated source of illumination electrically connected to said power source member.

2. The apparatus as in claim 1 wherein said signal actuating unit further comprises an apertured base plate member hingedly connected to said pressure plate member and provided with an enlarged off-set aperture that is dimensioned to allow the passage of the threaded bolt and prevent the passage of the threaded nut.

3. The apparatus as in claim 1 wherein the signal unit further comprises an elongated support rod for said source of illumination.

4. The apparatus as in claim 3 wherein said elongated support rod is further provided with a clamp member for operatively engaging the support rod in a vertical disposition relative to the side of the wheel ramp.

5. The apparatus as in claim 1 wherein said primary mounting unit is further provided with an auxiliary adjustable clamp member for operatively and movably engaging the apparatus at a desired location on the top support surface of the wheel ramp.

6. The apparatus as in claim 1 wherein said primary mounting unit is further provided with an auxiliary magnetic plate member which is magnetically engaged with the power source member and a portion of the support surface of said wheel ramp.

* * * * *